United States Patent [19]

Wohnhas et al.

[11] 4,412,748

[45] Nov. 1, 1983

[54] GRAVITY CIRCULATION MIXER

[75] Inventors: Norbert Wohnhas; Wolfgang Siegel, both of Ravensburg, Fed. Rep. of Germany

[73] Assignee: Waeschle Maschinenfabrik GmbH, Ravensburg, Fed. Rep. of Germany

[21] Appl. No.: 286,544

[22] Filed: Jul. 24, 1981

[30] Foreign Application Priority Data

Aug. 1, 1980 [DE] Fed. Rep. of Germany ..... 3029393

[51] Int. Cl.[3] ..... B01F 5/10; B01F 5/24

[52] U.S. Cl. ..... 366/341; 366/101

[58] Field of Search ..... 366/101, 106, 107, 341, 366/102, 105, 9, 136, 137, 159, 348, 349

[56] References Cited

U.S. PATENT DOCUMENTS 2,586,818 2/1952 Harms ..... 366/107
2,868,516 1/1959 Moseley ..... 366/136
3,106,385 10/1963 Arthur ..... 366/101
3,421,477 1/1969 Gilbert ..... 366/137
4,067,623 1/1978 Klein ..... 366/106

*Primary Examiner*—Robert W. Jenkins
*Attorney, Agent, or Firm*—Michael J. Striker

[57] ABSTRACT

A gravity circulation mixer for bulk goods including a mixing container in which the bulk goods are divided into two quantity flows. After having recombined the two individual quantity flows of bulk goods in a mixing bowl, it is conveyed via a vertical ascending pipe and a gravity pipe back into the mixing container. The gravity pipe is arranged at an angle with respect to the ascending pipe and extends downwardly into the mixing container. The connection between the ascending pipe and the gravity pipe is constituted by a baffle portion so that the upwardly conveyed bulk goods are deflected at the baffle portion and caused to fall into the mixing container.

6 Claims, 2 Drawing Figures

GRAVITY CIRCULATION MIXER

Figure 1:
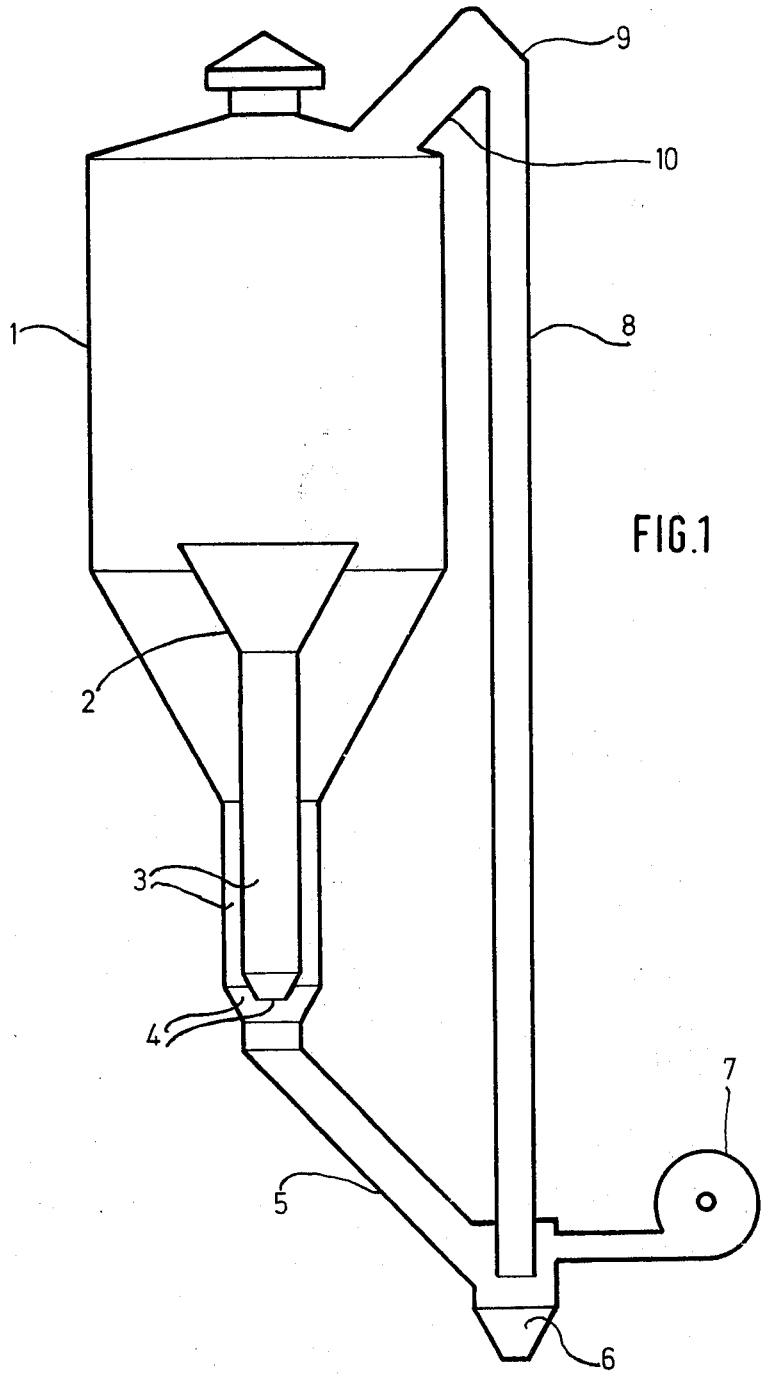

The invention relates to a gravity circulation mixer in accordance with the type known from claim 1 DE-OS No. 27 42 904.

In this circulation mixer, as well as in the circulation mixer of similar types which are known from DE-PS No. 19 37 374, DE-PS No. 22 19 397 and the U.S. Pat. No. 145,975, the ascending pipe is designed as a center pipe concentrically disposed to the center axis of the mixing container. While the realized mixing principle has been successful in smaller and medium sized volumes in the practical application, namely a rapid material protecting and energy saving homogenisation of granulated and dust like bulk goods, it has been shown that in mixing containers with a large volume severe constructive problems do occur with respect to the dimensioning of the center pipe and the locations for mounting. The cause is the static and dynamic mostly one sided stress of the surrounding resting or flowing bulk material. Relieve measures in form of additional installations are known (see DE-OS No. 27 58 902) but are very cumbersome and expensive in practical applications and mostly shift the mounting problems to other places of the mixing container and prevent the free flow of the bulk goods into the mixing container.

Circulation mixers are already known wherein the ascending pipe extends excentrically to the center axis of the mixing container (DE-OS No. 28 19 726). Since the one sided stress of the ascending pipe is already constructively limited, the heretofore mentioned mounting problems are present to a much higher degree.

Therefore, circulation mixers are already known with ascending pipes mounted outside of the mixing container, namely from the aforementioned DE-OS No. 27 42 904, as well as from DE-OS No. 28 03 479. In the first case the separately drawn off quantity flows from the mixing container and are fed at separate places into a horizontal feeding line which transfers into the actual ascending pipe by an intermediary pipe bend, whereby the upper end of the ascending pipe is connected with the upper part of the mixing container by means of a further pipe bend. In the latter case, the bulk goods is received at numerous places in the lower part of the mixing container through the pipes which discharge into a common mixing bowl disposed below the mixing container which is provided with a subsequent bucket wheel charging valve with which the bulk goods is fed through a feeding chute into a horizontal feeding line from where it is returned into the upper part of the mixing container by means of a pipe bend or a deflector, an ascending pipe and a further pipe bend.

In these two structures with center disposed ascending pipe it is disadvantageous that because of the two pipe bends of the ascending pipe and the additional horizontal feeding path considerably higher feeding speeds are required than with circulation mixers having a feeding pipe disposed as a center pipe. This higher speed of the feeding air is about 1.5 to 3 times higher depending on the construction and the type of the bulk goods requires a correspondingly high amount of energy and stresses or wear and tear on the bulky goods and the feeding pipes for the bulk goods.

It is therefore an object of the invention to provide a gravity circulation mixer of the mentioned type which operates in an energy saving and material protective manner.

This object of the invention is obtained by the characterizing features of claim 1.

This solution has the advantage that the operation can be performed with the same feeding air as in the case of a circulation mixer having an ascending pipe designed as a center pipe.

By the measures stated in patent claims 2 and 3 it is achieved that the required deflection of the bulk goods from the ascending pipe back into the mixing container does not require any additional energy.

The further embodiment as stated in claim 4 may be advantageous when the separation of the bulk goods flow is performed in at least two partial flows not by concentric installations in the mixing container, but by one or a plurality of radial separating walls in the container.

Basically, the stationary or changeable adjustment or dosaging of the quantity flows immediately to the given discharge openings as well as to each given point of the associated discharge conduits or gravity pipes. However, the arrangement of the corresponding throttle elements of claim 5 is particularly advantageous, wherein the elements are provided at or in the proximity of the discharge opening of the gravity pipes into the mixing bowl. This permits to design the given gravity pipes as a throttle path in accordance with claim 6. In these throttle paths the required super pressure of the feeding medium is so reduced that the leakage air flow in the throttle path does not hinder the supply of the bulk goods to the mixing bowl. In this manner, discharge elements like bucket wheel charging valves, proportioning screws and the like are superfluous.

In accordance with the invention the drawings show an exemplified two embodiments of the gravity circulation mixer in accordance with the invention in schematically simplified shapes.

Figure 2:
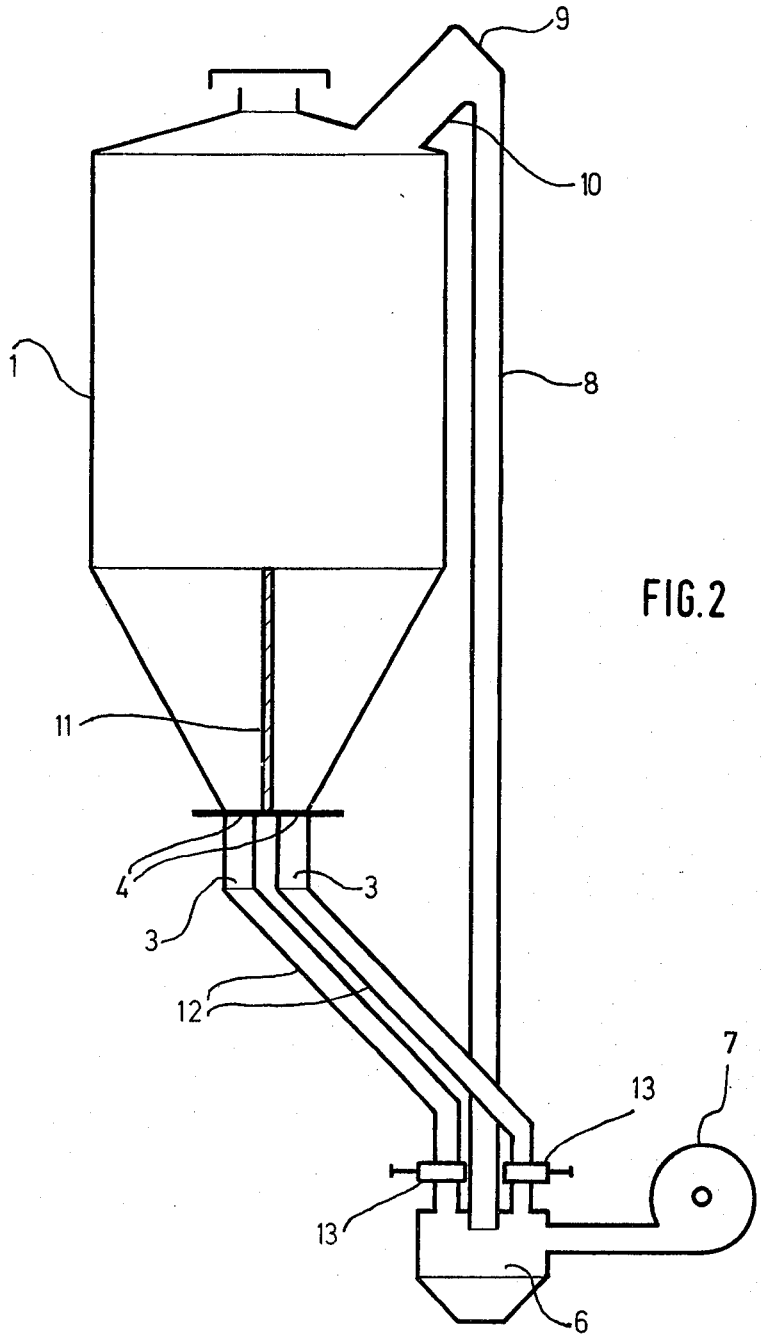

The drawings show:

FIG. 1 a first embodiment in a sectional view,

FIG. 2 a second embodiment also in a sectional view.

In the circulation mixer shown in FIG. 1, the bulk goods is fed from the mixing container 1 through a mixing funnel 2, as well as over the space limited by the container cone to the discharge conduits 3 which end up in discharge openings 4, the predetermined cross section defines the dosaging of the two partial quantity flows. Subsequent to the discharge openings 4 the two partial quantity flows again merge and are fed through an oblique gravity pipe 5 and into a mixing bowl 6 wherein they are pneumatically fed into a vertical ascending pipe 8. The air required for the pneumatic feeding is supplied by a ventilator 7. The super pressure required for the feeding in the mixing bowl 6 is reduced by the leakage air flow in the discharge conduits 3 which are filled with the bulk goods and act as throttle paths. Naturally, these conduits are so dimensioned that the leakage air flow does not prevent the bulk goods to be fed through the discharge openings 4.

After a protective feeding with a lower air speed through the vertical ascending pipe 8 the bulk goods is fed to a baffle bowl (9) is deflected therein and drops through a gravity pipe 10 back into the mixing container 1. The gravity pipe 10 has a substantially larger cross section than the ascending pipe 8, so that no acceleration of the product takes place after the feeding into ascending pipe 8.

Another embodiment of the circulation mixer is shown in FIG. 2. In a different way, as shown in FIG. 1, the bulk goods flow is not carried out by means of a mixing funnel into two quantity flows, but by a separating wall 11, whereby these quantity flows flow through two adjacent separating discharge conduits 3. Subsequent to the discharge conduits 3 two oblique gravity pipes 12 are disposed which discharge into into the laterally offset mixing bowl 6. In close proximity to the lower end of the gravity pipes 12 adjustable slides 13 are provided which determine the dosaging cross sections. Naturally, instead of slides other throttle members may be used.

In this arrangement, the two oblique gravity pipes 12 act as throttle paths, wherein the excess pressure of the feeding air is reduced. The remainder parts of the embodiment in accordance with FIG. 2 have the same function as the corresponding parts of FIG. 1.

In a deviation of this embodiment which is not shown in the drawings, the discharge conduits 3 may be shaped as a throttle path similar as in FIG. 1. For this purpose, they have to be accordingly extended and have to be provided with stationary or adjustable throttle elements (similar to the slides 13) at the lower ends. The two partial quantity flows can be immediately merged after the throttle elements and can be fed through a common gravity pipe 5 to mixing bowl 6, in the same manner as in FIG. 1.

We claim:

1. A gravity circulation mixer for bulk goods including a mixing container having an upper part and a conical bottom, at least two discharge openings for separating the flow of the bulk goods into two quantity flows, a mixing bowl connected to these openings, the mixing bowl being provided with an opening for supplying feeding air and an ascending pipe connecting the bowl to the upper part of the mixing container, characterized in that the ascending pipe (8) is disposed externally of the mixing container (1) in a vertical position and is connected to a first gravity pipe (10) which extends downwardly into the upper part of the mixing container, that the mixing bowl (6) is laterally offset with respect to the center axis of the mixing container so as to be coaxially disposed in the ascending pipe (8), and that at least a second gravity pipe (5, 12) is provided which extends obliquely to the ascending pipe and connects the discharge openings (4) with the mixing bowl.

2. A circulation mixer in accordance with claim 1, characterized in that a baffle portion (9) is provided between the upper end of the ascending pipe (8) and the first gravity pipe (10).

3. A circulation mixer in accordance with claim 1, characterized in that the first gravity pipe (10) has a larger diameter than the ascending pipe (8).

4. A circulation mixer in accordance with claim 1, characterized in that each discharge opening (4) is connected with the mixing bowl (6) by an individual gravity pipe (12).

5. A circulation mixer in accordance with claim 4, characterized in that a throttle member (13) for adjusting the corresponding quantity flow is disposed in each of the individual gravity pipes prior to the mixing bowl (6) with respect to direction of flow of the bulk goods.

6. A circulation mixer in accordance with claim 5, characterized in that the individual gravity pipes (12) are designed as throttle paths.

* * * * *